US005687588A

United States Patent [19]

Azzani et al.

[11] Patent Number: 5,687,588

[45] Date of Patent: Nov. 18, 1997

[54] PACKAGE ASSEMBLY FOR GRANULAR PRODUCT

[75] Inventors: Jean-Luc Azzani, Rome, Italy; Henri Cornette, Pontoise, France

[73] Assignee: The Procter & Gamble Company, Cincinnati, Ohio

[21] Appl. No.: 628,728

[22] PCT Filed: Oct. 14, 1994

[86] PCT No.: PCT/US94/11760

§ 371 Date: Sep. 11, 1996

§ 102(e) Date: Sep. 11, 1996

[87] PCT Pub. No.: WO95/11330

PCT Pub. Date: Apr. 27, 1995

[30] Foreign Application Priority Data

| | | | |
|---|---|---|---|
| Oct. 18, 1993 | [EP] | European Pat. Off. | 93870203 |
| Dec. 14, 1993 | [EP] | European Pat. Off. | 93203509 |

[51] Int. Cl.[6] ..... D06F 39/02

[52] U.S. Cl. ..... 68/17 R; 510/277; 510/293; 510/439

[58] Field of Search ..... 68/17 R; 510/277, 510/293, 439; 206/216; 220/560

[56] References Cited

U.S. PATENT DOCUMENTS

| | | | |
|---|---|---|---|
| 4,776,972 | 10/1988 | Barrett | 510/293 X |
| 4,858,758 | 8/1989 | Mitchell et al. | 510/277 X |
| 4,969,927 | 11/1990 | Schumann et al. | 68/17 R X |

FOREIGN PATENT DOCUMENTS

| | | | |
|---|---|---|---|
| 0253419 | 1/1988 | European Pat. Off. | 68/17 R |
| 0346113 | 12/1989 | European Pat. Off. | 68/17 R |

*Primary Examiner*—Philip R. Coe
*Attorney, Agent, or Firm*—Ronald W. Kock

[57] ABSTRACT

A package assembly for a granular product. The package assembly has a container for storing a granular product and an external surface to which is releasably attached a separate device for dispensing a granular product in an automatic washing machine. The separate device has no communication with the internal volume of the container storing the granular product. The container for storing the granular product has a removable lid attached by means of a hinge device.

2 Claims, 2 Drawing Sheets

PACKAGE ASSEMBLY FOR GRANULAR PRODUCT

The invention relates to a package assembly containing a granular product, said package assembly comprising a reclosable container of thermoplastic material and a device for dispensing said granular product.

In general such packages are often supplied with a measuring device such as a spoon with graduated marking to indicate volumes. Such a device may be used to pour the product into the dispensing compartment (such as a dispensing drawer) of a washing machine. Dispensing devices are also known; the purpose of these devices being to carry the granular product directly into the washing machine and to release it during the wash cycle itself.

A package for storing and dispensing granular materials has been described in U.S. Pat. No. 5,115,966, May 26th 1992. A corner cap suitable for measuring quantities of the granular material is provided and may be clipped over the corner of the package. The package disclosed is made from paperboard, and the corner cap which is intended for use as a measuring or dosing device, is not suited for use as a dispensing device to deliver the granular product into the washing machine during the course of the wash cycle itself.

Various dispensing devices have been suggested in the prior art including German Design Registration MR26344, published on Sep. 30th, 1986. This design registration discloses a plastic canister for liquid detergents which has a recess in the middle of one side which can accommodate a dosing ball.

However it has been common practice in the past to provide granular detergent products in a carton and to encourage the consumer to store a dispensing device inside that carton along with the granular product. This has been the case for both paperboard packages, and more recently for plastic refillable containers. However, this can give rise to problems. The dispensing device is often still damp when it is removed from the washing machine at the end of a completed cycle. If this device is immediately placed inside the package with the granular product, then this dampness can easily cause caking of the product which is clearly undesirable. If the device is not immediately placed inside the package however, there is a risk that it easily becomes lost or damaged.

The present invention offers a solution to this problem. The invention is concerned with plastic containers, which are suitable for refilling with product many times. A means for fitting a dispensing device to the outside of the plastic container in such a way that it is safely stored and yet cannot come into direct contact with the granular product during storage. The dispensing device is easily removable from the plastic container when required for use, and may then be fitted back on to the outside of the container after use. This may be repeated many times.

DESCRIPTION OF THE INVENTION

For the purposes of the description of the present invention herein, the term "releasably attached" means that the dispensing device and the container can be easily and positively locked together by the consumer, and that the dispensing device and the container can be released from each other, and then reconnected any number of times. A means of positively locking the components together is provided.

One such means of locking the components together is a projection, or a plurality of projections on the external surface of the container which engage in an opening of the dispensing device. Preferably the dispensing device can then be "clipped-on" to the external surface of the container. The dispensing device may be removed and reattached to the container many times.

An alternative means of locking the components together is a recess or cavity in the external surface of the container which is shaped to receive the dispensing device. The dispensing device is wholly or partly retained within the recess or cavity by frictional interference between said container and said dispensing device. Once again the dispensing device may be removed and reattached to the container many times.

Embodiments of the invention are described in detail below with reference to the drawings which illustrate only preferred embodiments.

The figures show a package assembly 10 comprising a reclosable container of thermoplastic material 11 having an internal volume and an external surface, and a device 12 for dispensing said granular product. The dispensing device 12 is releasably attached to the external surface of the container. The dispensing device can be removed and replaced repeatedly on the container in such a manner that it never comes into contact with the granular product which is kept in the internal volume of the container 11.

Figure 2:
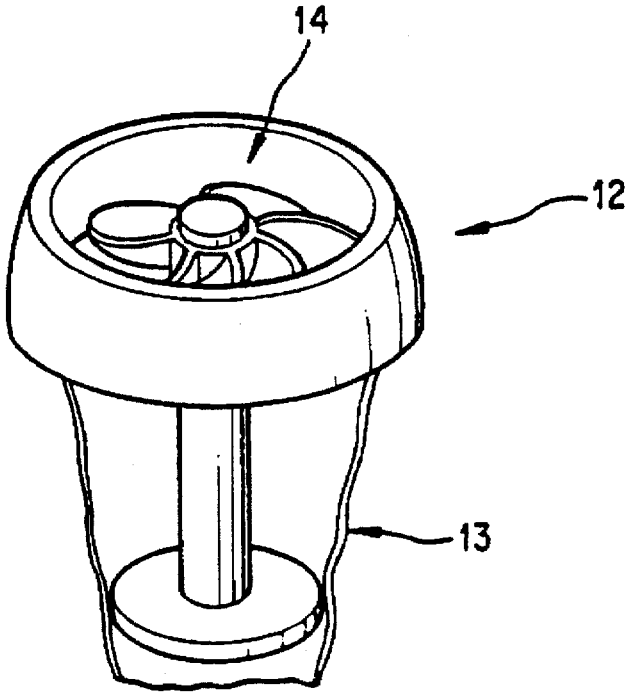
FIG. 2 shows a perspective view with cut-away section of a dispensing device.

A dispensing device 12 is shown in FIG. 2 in more detail. The dispensing device 12 comprises a body 13, having an opening 14, said opening being adapted to admit to the body a quantity of granular laundry detergent required for one washing cycle of an automatic washing machine and to release said granular laundry detergent from said body directly into the drum of the automatic washing machine during the washing cycle.

Figure 1:
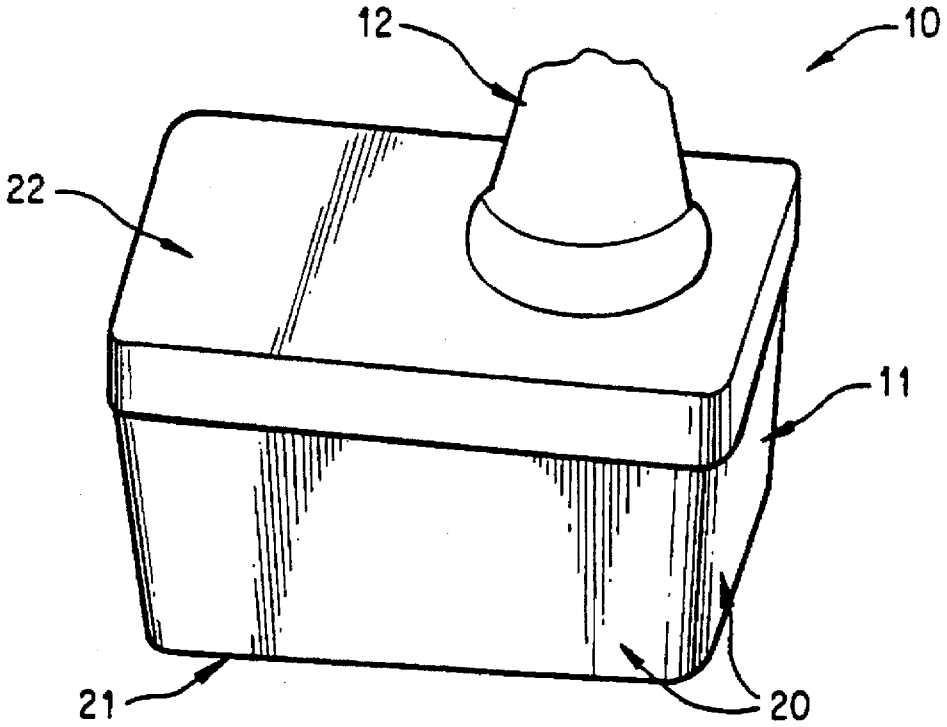
FIG. 1 shows a perspective view of a package assembly.

In a preferred embodiment of the present invention shown in FIG. 1, a package assembly 10 comprising a reclosable container 11 and a dispensing device 12, the reclosable container comprising side walls 20, a bottom surface 21 and a top surface 22 defining an internal volume, wherein the top surface 22 is a removable lid allowing access to the contents of said container 11. The dispensing device is releasably attached to the lid of the container 11 and the internal volume of the container 11 is not in direct communication with the releasably attached dispensing device 12 when the lid of the container 11 is closed.

Figure 3:
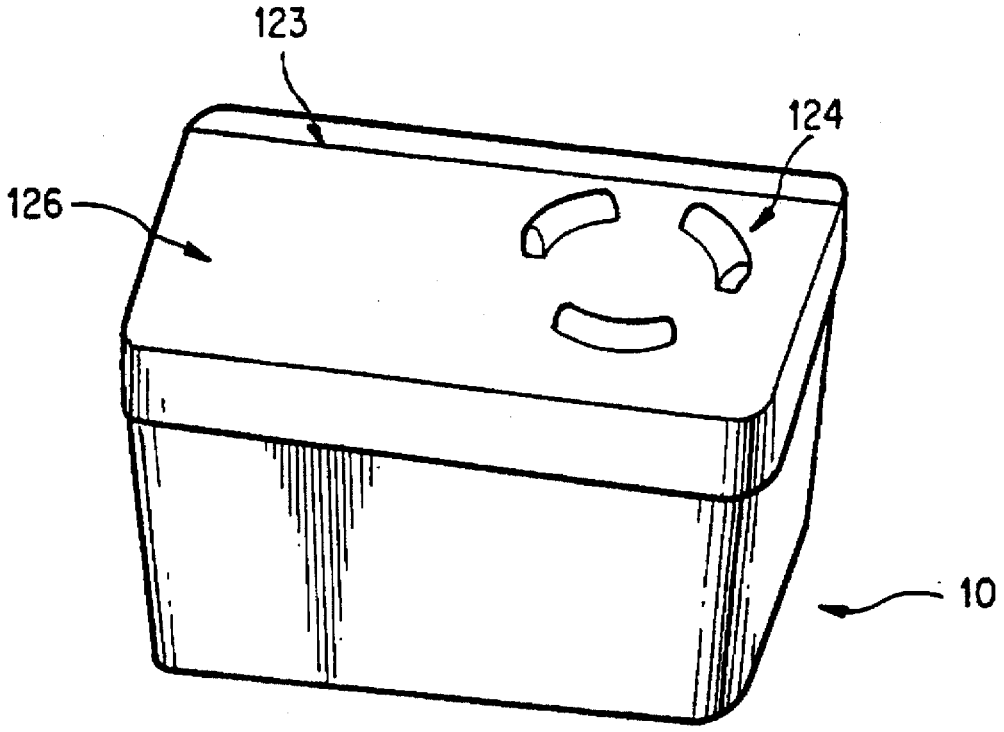
FIG. 3 shows a perspective view of a container with the dispensing device omitted.

FIG. 3 shows an alternative, and more preferred embodiment of the present invention, in which a removable part of the lid 126 is connected to the reclosable container 11 by means of a hinge device 123, the hinge device 123 being located adjacent to part of the side wall 20. The hinge device 123 shown is about the same length as the adjacent, parallel side wall 20. (The dispensing device has been omitted from FIG. 3 for clarity).

Figure 4:
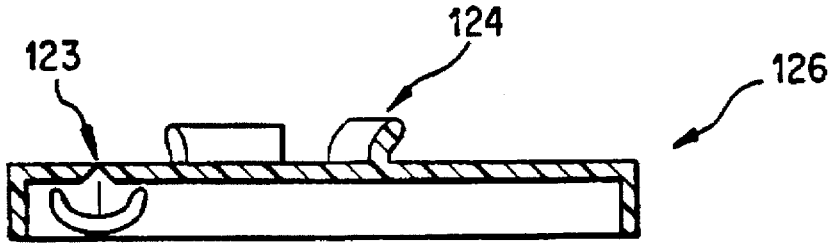
FIG. 4 shows a cross-section of one embodiment of a hinged lid for the container.
Figure 5:
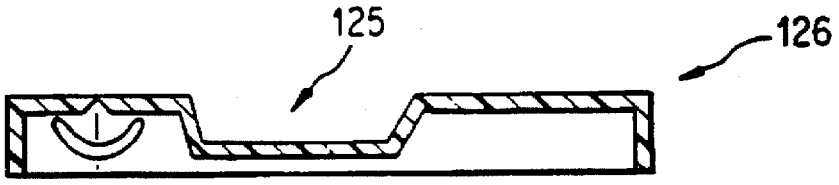
FIG. 5 shows a cross-section of another embodiment of a hinged lid for the container.

The dispensing device 13 may be releasably attached to said lid 126 in various ways; two possible ways by which this may be achieved are shown in FIGS. 4 and 5.

FIG. 4 shows a lid 126 with a plurality of projections 124 on it which engage in an opening 14 of said dispensing device 12. The projections enable the dispensing device to be "clipped-on" to the lid 126 during storage, and then readily removed when the dispensing device is required. The removal and reattachment of the dispensing device to the lid may be repeated many times. (The dispensing device 12 itself is omitted from this figure for clarity).

In another alternative embodiment of the present invention shown in FIG. 5, the dispensing device 12 is releasably attached to said container by means of a recess or cavity 125 in the lid 126. The recess or cavity is designed such that the body of the dispensing device is wholly or partly retained within the recess or cavity by frictional interference between the container and the dispensing device. Again it is the intention that the dispensing device can be removed and reattached to the lid many times.

What is claimed is:

1. A package assembly (10) containing a granular product, said package assembly comprising a reclosable container (11) of thermoplastic material having an internal volume and an external surface; a device (12) for dispensing said granular product; and a means for the releasable attachment of said dispensing device to said external surface of said container, wherein the internal volume of said container is not in direct communication with said releasably attached dispensing device when said container is closed, said dispensing device having a body (13), said body having at least one opening (14) allowing for a quantity of granular product required for one washing cycle of an automatic washing machine to be admitted to said body and to release said granular product from said body directly into a drum of an automatic washing machine during said washing cycle, said means for releasably attaching said dispensing device being at least one projection on said external surface of said container which engages said opening of said dispensing device, said reclosable container having a side wall (20), a bottom surface (21), and a top surface (22) defining said internal volume, and wherein at least a part of said top surface is a removable lid (126) allowing access to said granular product in said container, said removable lid being connected to said reclosable container by means of a hinge device (123), said hinge device being located adjacent to, and parallel with, a part of said side wall.

2. A package assembly according to claim 1 wherein said hinge device (123) is at least as long as the adjacent, parallel side wall (20).

* * * * *